US005874806A

United States Patent [19]

Pasco et al.

[11] Patent Number: 5,874,806

[45] Date of Patent: Feb. 23, 1999

[54] PASSIVE JITTER REDUCTION IN CROSSED-FIELD AMPLIFIER WITH SECONDARY EMISSION MATERIAL ON ANODE VANES

[75] Inventors: Richard J. Pasco, So. Williamsport; Chris L. Wheeland, Winfield, both of Pa.

[73] Assignee: Litton Systems, Inc., Woodland Hills, Calif.

[21] Appl. No.: 725,121

[22] Filed: Oct. 2, 1996

[51] Int. Cl.[6] ..... H01J 23/02

[52] U.S. Cl. ..... 315/39.63; 313/103 R

[58] Field of Search ..... 315/5.11, 5.12, 315/39.3, 39.63; 330/47; 313/103 R

[56] References Cited

U.S. PATENT DOCUMENTS

| | | | |
|---|---|---|---|
| 2,653,259 | 9/1953 | Scott | 315/39.3 X |
| 3,109,123 | 10/1963 | Spencer | 313/103 R X |
| 3,297,901 | 1/1967 | MacDonald et al. | 315/39.51 |
| 3,896,332 | 7/1975 | Heathcote | 315/39.51 |
| 3,899,714 | 8/1975 | Esterson et al. | 315/39.51 |
| 3,967,155 | 6/1976 | Chavanat et al. | 315/5.12 X |
| 4,053,804 | 10/1977 | Aboelfotoh | 313/218 |
| 4,145,635 | 3/1979 | Tuck | 315/39 |
| 4,677,342 | 6/1987 | MacMaster et al. | 315/39.3 |
| 4,700,109 | 10/1987 | MacPhail | 315/39.3 |
| 4,814,720 | 3/1989 | MacPhail et al. | 330/47 |
| 4,894,586 | 1/1990 | Crager et al. | 315/39.51 |
| 5,327,094 | 7/1994 | Vaughan et al. | 330/47 |
| 5,412,281 | 5/1995 | Farney et al. | 315/39.3 |

FOREIGN PATENT DOCUMENTS

| | | |
|---|---|---|
| 0 593 768 A1 | 4/1994 | European Pat. Off. . |
| WO 93/21648 | 10/1993 | Russian Federation . |
| 969833 | 9/1964 | United Kingdom . |
| 1083833 | 9/1967 | United Kingdom . |
| 1 449 614 | 9/1976 | United Kingdom . |
| 2 133 614 | 7/1984 | United Kingdom . |
| 2 148 048 | 5/1985 | United Kingdom . |

*Primary Examiner*—Robert J. Pascal
*Assistant Examiner*—Justin P. Bettendorf
*Attorney, Agent, or Firm*—Graham & James LLP

[57] ABSTRACT

A crossed-field amplifier is provided having a cathode structure with an emitting surface which emits secondary electrons upon impingement of priming electrons, an anode vane structure surrounding the cathode and a signal input port located adjacent the anode vanes. A secondary emission material is disposed in an area proximate the signal input port for providing priming electrons in the interaction region of the amplifier. The RF input signal causes the secondary emission material to emit priming electrons for use by the cathode structure. The creation of priming electrons in the interaction area reduces irregular start-up or "jitter" typically experienced with the amplifier at low pulse repetition frequencies.

18 Claims, 3 Drawing Sheets

PASSIVE JITTER REDUCTION IN CROSSED-FIELD AMPLIFIER WITH SECONDARY EMISSION MATERIAL ON ANODE VANES

BACKGROUND OF THE INVENTION

1. Field of the Invention

The present invention relates to a crossed-field amplifier and, more particularly, to an electron-emitting material used within a crossed-field amplifier to reduce amplifier jitter caused by stopping and restarting the amplifier.

2. Background

Crossed-field amplifiers ("CFA's") have been used for several years in electronic systems that require high RF power, such as radar systems. A CFA operates by passing an RF signal through a high voltage electric field formed between a cathode and an anode. The cathode emits electrons which interact with an RF wave as it travels through a slow-wave path provided in the anode structure surrounding the cathode. The RF wave is guided by a magnetic field, which crosses the electric field perpendicularly. Crossed-field amplifiers are disclosed in U.S. Pat. No. 4,700,109, issued Oct. 13, 1987 to MacPhail, and U.S. Pat. No. 4,814,720, issued Mar. 21, 1989, to MacPhail et al., both assigned to the common assignee, and which are incorporated herein by reference.

In some applications, it is desirable to operate the CFA in a pulsed mode in which the CFA is repeatedly turned on and off. If used in a radar system, accuracy of the pulse timing is critical to obtaining accurate return information. To start a CFA, there must exist a small number of electrons in the interaction region in order to prime the operation of the cathode. These priming electrons come from natural sources, such as residual radioactivity, electron storage from preceding pulses, cosmic rays, etc. The priming electrons impact the cathode structure causing secondary emissions of electrons from the cathode surface, further resulting in a cascade of electrons flowing in a beam through the interaction region. At relatively high pulse repetition frequencies, a large number of electrons remain in the interaction region after the CFA has been turned off. These remaining electrons prime the CFA to rapidly restart the secondary emission process. However, at low pulse repetition frequencies the electrons in the interaction region dissipate into the anode structure, leaving an absence of electrons to prime the CFA upon restart. Although the natural source electrons will eventually start the CFA, the startup time cannot be determined with certainty. Thus, the restart of the CFA at low pulse repetition frequencies is highly irregular, and is a phenomenon known as "jitter."

Several solutions to the jitter problem have been proposed. One solution involves the use of a bias circuit which holds a supply of electrons in the interaction region between the cathode and the anode when the CFA is turned off. The bias circuit is disclosed in U.S. Pat No. 4,895,586, issued Jan. 16, 1990, to Crager et al., which is assigned to the common assignee. The bias circuit supplies a negative DC voltage to the cathode which holds the electrons within the interaction region. A significant drawback of this method is that a power supply and transformer are required to supply and regulate the DC voltage. The addition of the power supply increases the complexity of the CFA, and the DC voltage must be insulated from the cathode pulse voltage, which is typically more than 10,000 volts.

Other solutions involve the use of a thermionic emitting filament disposed in a space provided between the anode vanes of the CFA. The filament thermionically emits a number of electrons in response to the application of an external low voltage. The voltage differential created by the RF wave accelerates the electrons emitted by the filament. The active filament, however, requires an external power source. Moreover, the filament's life is finite. Both of these characteristics tend to decrease the stability of the CFA.

Current solutions involve the encouragement of multipactor electron discharge in the CFA. Data suggests that such discharge occurs in the CFA due to the RF field provided by the RF input drive signal. The discharge occurs on copper surfaces of the CFA that have been lightly oxidized. Oxidization is encouraged by maintaining high oxygen levels in the CFA. Unfortunately, maintaining artificially high pressures of oxygen increases the tendency of the CFA to arc.

Accordingly, there is a need for a solution to the jitter problem that does not rely on external power sources.

Further, there is a need for a jitter solution that does not decrease the stability of the CFA.

Further, there is a need for a jitter solution that does not require artificially high partial pressures of oxygen within the CFA.

SUMMARY OF THE INVENTION

The present invention satisfies the need for a solution to the jitter problem that does not require an external power source. The present invention further satisfies the need for a jitter solution that does not decrease the stability of the CFA and does not require artificially high partial pressures of oxygen within the CFA.

Accomplishing these and other objectives, there is provided a secondary emission material disposed on one or more of the anode vanes of the crossed-field amplifier. The secondary emission material provides priming electrons in the interaction region of the amplifier. Among the secondary emission materials that may be chosen are platinum, beryllium oxide or gold magnesium oxide, although other secondary emission materials may be used. These materials emphasize a stable secondary emission characteristic, thus obviating the need for artificially high partial pressures of oxygen to support an electron supply.

A more complete understanding of the crossed-field amplifier will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1:
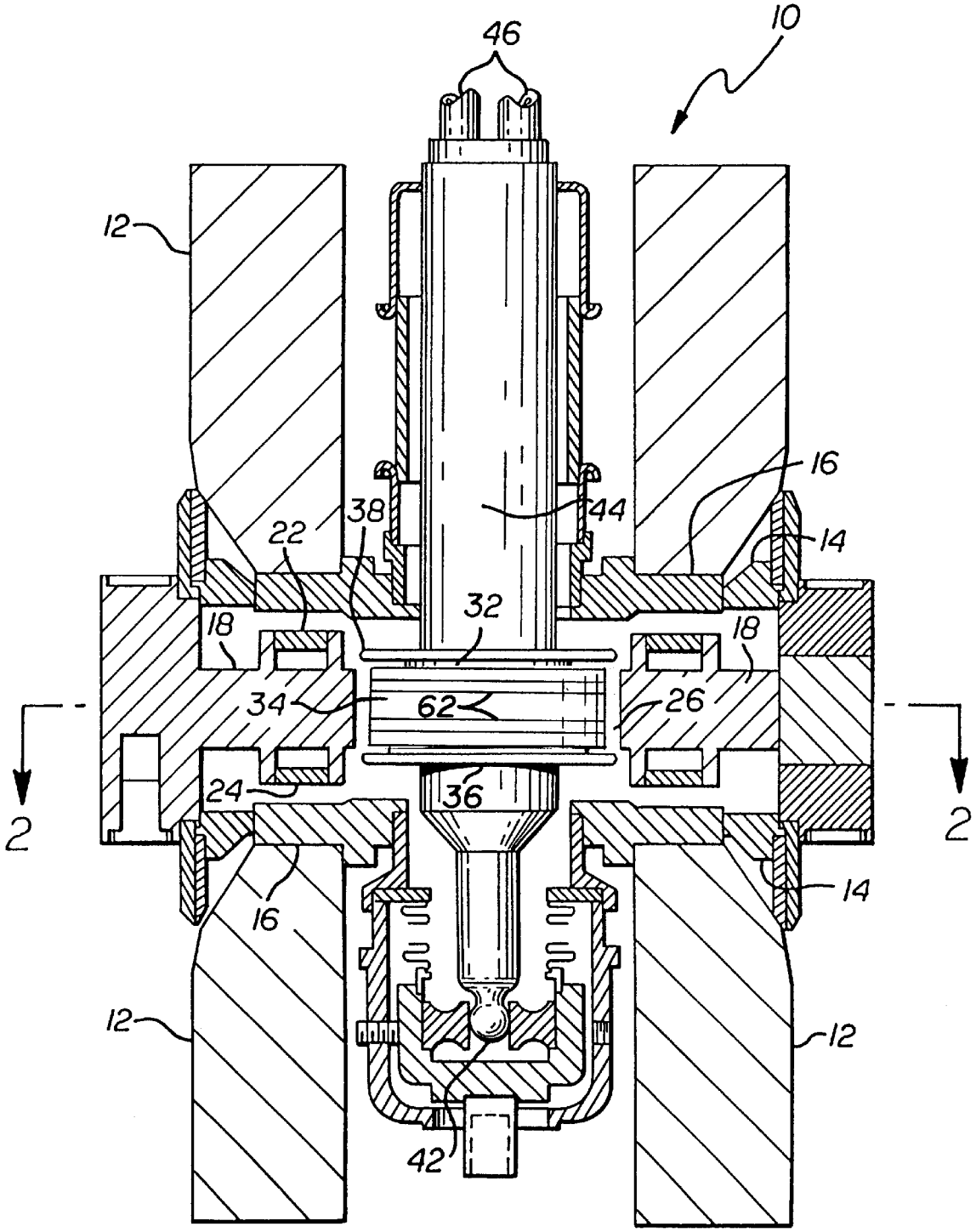
FIG. 1 is a cross-sectional side view of a crossed-field amplifier.

Referring now to the drawings, FIG. 1 shows a crossed-field amplifier 10 formed between a pair of hollow, cylindrically-shaped permanent magnets 12. The pair of magnets 12 are mounted above and below a body ring 14 of the CFA, which forms part of the anode as will be fully described below. The body ring 14 is sealed by a cover 16 which secure to the magnets 12.

A plurality of anode vanes 18 extend radially inward from the inner surface of the body ring 14. The vanes 18 are electrically connected together by machined helices 22 and 24. Helices 22 and 24, vanes 18, and body ring 14 are all electrically connected together to form the anode. Although machined helices 22 and 24 are shown in FIG. 1, it is also known in the art to use a wire coil helix having windings which are electrically connected to the anode vanes 18. The inventive concepts described herein are equally applicable to either a CFA having a wire coil or machined helix.

A cathode 32 is coaxially disposed within the body ring 14 and is surrounded by the radially extending anode vanes 18. The cathode 32 has a cylindrically-shaped emitting surface 34, and an upper and lower end shield 38 and 36, respectively, disposed at each end of the emitting surface. The emitting surface 34 is generally formed of beryllium and the spacers 62 are generally formed of beryllium. A cathode terminal 42 is provided with a high negative voltage, such as −13 KV, through a central bore in lower magnet 12. A mechanical support rod 44 secures to the upper end shield 38, providing structural support for the cathode 32. A plurality of coolant tubes 46 extend axially through the mechanical support rod 44, to provide a coolant fluid to maintain the cathode 32 and emitting surface 34 at a constant temperature.

Figure 2:
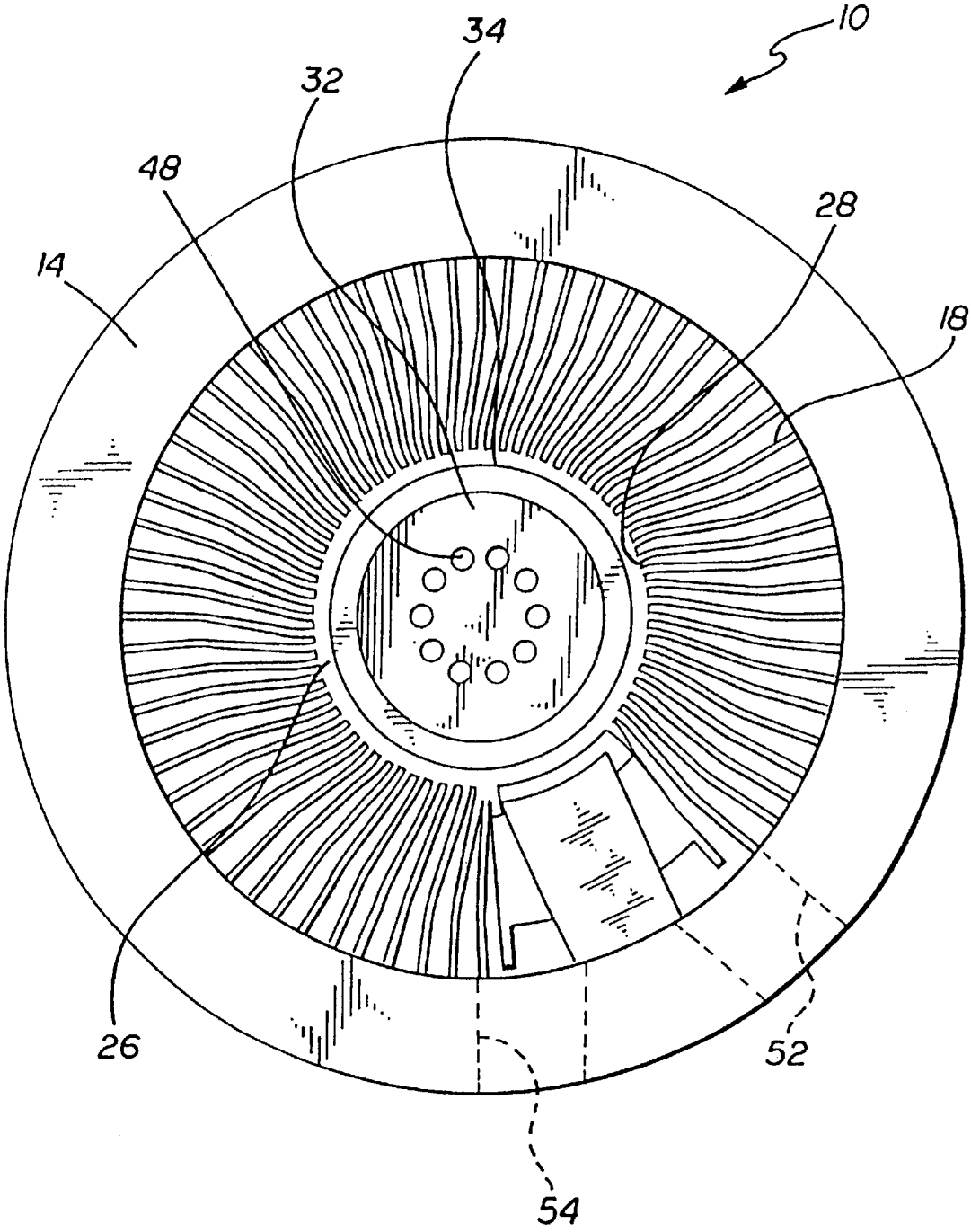
FIG. 2 is a cross-sectional top view of the crossed-field amplifier of FIG. 1.

Referring now to FIG. 2, there is shown a cross-sectional top view of the CFA structure shown in FIG. 1. The view shows the cathode 32 coaxially disposed within the plurality of radially extending anode vanes 18 which are secured to the body ring 14. A plurality of coolant holes 48 extend axially through the cathode 32 which are joined to the coolant tubes 46 described above with respect to FIG. 1. An RF input port 52 and an RF output port 54 extend through the body ring 14 to provide an input and output path for an RF signal provided to and from the CFA, respectively. An interaction region 26 (see also FIG. 1) is provided between the cathode surface 34 and the tips 28 of the anode vanes 18.

In operation, a high negative voltage is applied to the cathode 32 relative to the anode vanes 18. The voltage causes electrons to be emitted from the cathode surface 34, producing a space-charge cloud of electrons surrounding the cathode 32. The magnets 12 provide a magnetic field which lies perpendicular to the electric field formed within the CFA structure 10. The magnetic field causes the electrons to orbit around the cathode structure 32, during which they interact with the RF input signal which enters the input port 52. Energy from the orbiting electrons is exchanged with the RF signal, causing the signal to become amplified. An amplified RF signal exits the CFA 10 through the output port 54 (see FIG. 2).

As is known in the art, the electrons which are caused to flow within the interaction region 26 are produced through a process of secondary emission. Typically, this secondary emission occurs through the use of beryllium oxide deposited on the cathode. The beryllium oxide emits secondary electrons after being impacted by priming electrons. An oxygen source is usually provided to the CFA to replenish the oxygen which becomes depleted from the cathode surface 34 during the secondary emission process. The priming electrons which initiate the secondary emission process typically originate from natural sources which are generally sufficient to initiate the secondary emission process, since an extremely small amount of electron current is necessary to start the beam. However, at relatively low pulse rate frequencies, delays in CFA start-up in the microsecond range may be experienced. Moreover, the increased pressures of oxygen in the device increase the likelihood of arcing in the beam.

Figure 3:
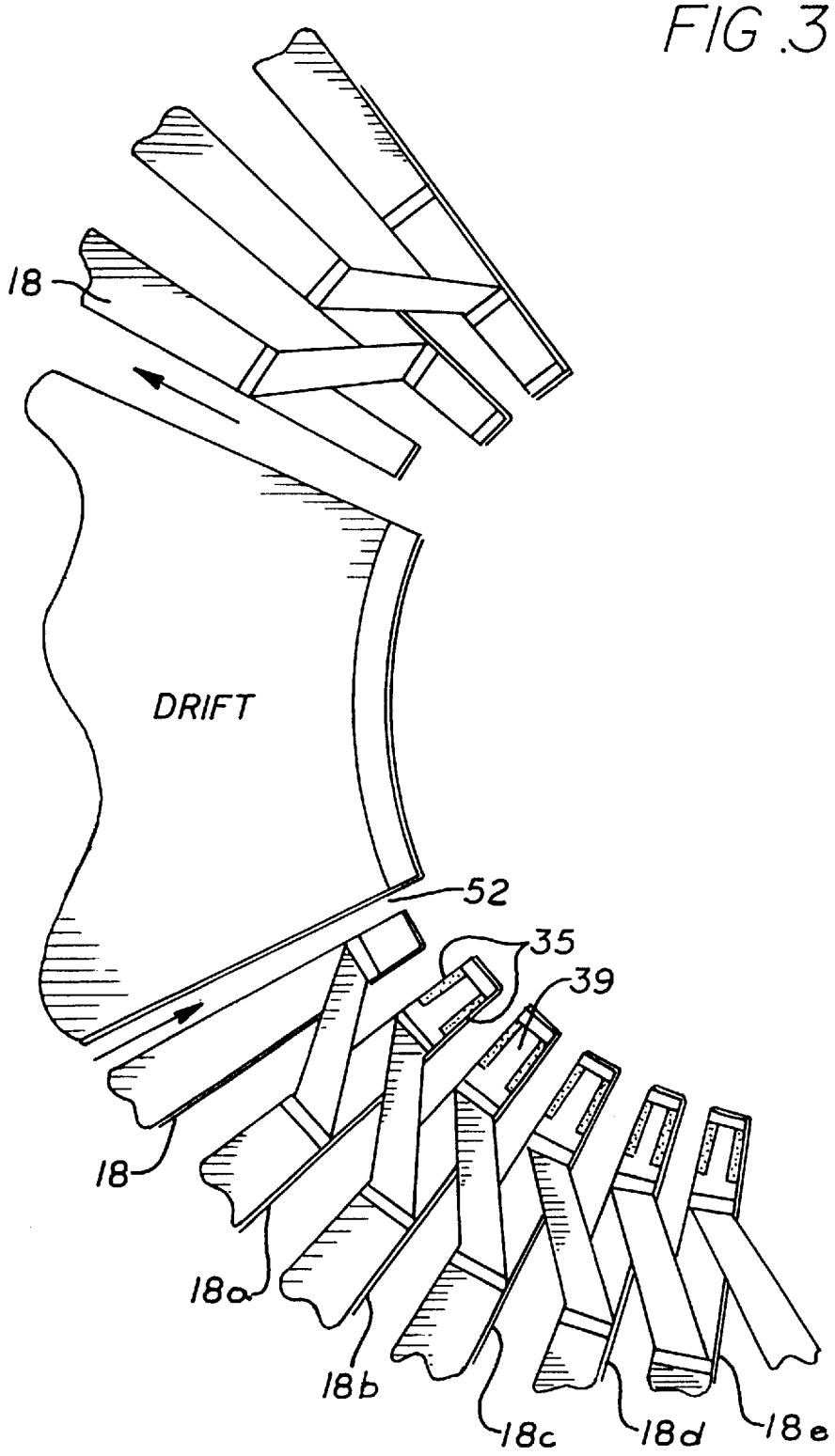
FIG. 3 is an enlarged top view of the anode vanes showing the secondary emission material of the present invention.

Referring now to FIG. 3, this invention discloses the use of a material 35 having a stable secondary emission ratio to provide a source of priming electrons. Suitable secondary emission materials include platinum, beryllium oxide, and gold magnesium oxide, although other suitable secondary emission materials may be used. The material 35 is preferably deposited in areas of the CFA where a large RF field exists due to the RF input signal. In a preferred embodiment, the secondary emission material 35 is deposited along surfaces of anode vanes 18 located proximate the input region 52 of the CFA. For example, as shown in FIG. 3, the material 35 may be deposited on an upper surface 39 of the anode vanes 18. The material 35 may also be deposited on other surfaces of the anode vanes 18. The large RF field and the secondary emission ratio of the material combine to increase the likelihood of multipactor electron discharge.

The material 35 is preferably placed on the upper surface 39 of anode vanes 18*a,* 18*b,* 18*c,* 18*d,* 18*e* near the tip of each vane. The secondary emission material 35 may be placed on a fewer or greater number of vanes depending upon particular applications. In any event, these vanes are preferably located proximate the RF input port 52. On each vane 18, the material 35 is preferably deposited on opposite sides of the upper surface 39. The material 35 is placed on the vane with a preferred thickness (distance from the upper surface 39 to the upper surface of the material 35) of approximately 0.010 inches. The length of the material 35 (distance lengthwise from the tip of the vane 18) is approximately 0.470 inches. The width of the material (distance from a side edge of the vane 18) is approximately 0.010 inches.

During operation of the CFA, the RF input signal interacts with the material 35 to cause a multipactor discharge of priming electrons in the interaction region 24. These priming electrons are present at the beginning of a CFA pulse, thus improving the starting characteristics of the CFA. Excessive partial pressures of oxygen are not required to cause the multipactor discharge as in the prior art. Moreover, the material 35 emits electrons prior to applying direct current to the CFA.

Having thus described a preferred embodiment of a crossed-field amplifier, it should be apparent to those skilled in the art that certain advantages of the within system have been achieved. It should also be appreciated that various modifications, adaptations, and alternative embodiments thereof may be made within the scope and spirit of the present invention. For example, secondary emission material disposed on an anode vane has been illustrated, but it should be apparent that the inventive concepts described above would be equally applicable to material disposed in areas proximate the anode vane. The invention is further defined by the following claims.

What is claimed is:

1. In a crossed-field amplifier having a cathode and a plurality of anode vanes creating an electric field across a magnetic field in an interaction region, the improvement comprising:

secondary emission means disposed entirely on a surface of at least one of the plurality of anode vanes for providing priming electrons in the interaction region of the amplifier.

2. The crossed-field amplifier, as recited in claim 1, wherein the secondary emission means includes platinum.

3. The crossed-field amplifier, as recited in claim 1, wherein the secondary emission means includes beryllium oxide.

4. The crossed-field amplifier, as recited in claim 1, wherein the secondary emission means includes gold magnesium oxide.

5. The crossed-field amplifier, as recited in claim 1, wherein the at least one anode vane is proximate an RF input port.

6. The crossed-field amplifier, as recited in claim 1, wherein the secondary emission means is disposed proximate a tip of the at least one of the plurality of anode vanes.

7. The crossed-field amplifier, as recited in claim 1, wherein the secondary emission means is disposed on an upper surface of the at least one of the plurality of anode vanes.

8. In a crossed-field amplifier having a cathode and a plurality of anode vanes creating an electric field across a magnetic field in an interaction region, the improvement comprising:

secondary emission regions disposed entirely on a surface of at least one of the plurality of anode vanes for providing priming electrons in the interaction region of the amplifier.

9. The crossed-field amplifier, as recited in claim 8, wherein the at least one anode vane is proximate an RF input port.

10. The crossed-field amplifier, as recited in claim 8, wherein the secondary emission regions include platinum material.

11. The crossed-field amplifier, as recited in claim 8, wherein the secondary emission regions include beryllium oxide material.

12. The crossed-field amplifier, as recited in claim 8, wherein the secondary emission regions include gold magnesium oxide material.

13. The crossed-field amplifier, as recited in claim 8, wherein the secondary emission regions are disposed proximate a tip of the at least one of the plurality of anode vanes.

14. The crossed-field amplifier, as recited in claim 13, wherein the secondary emission regions are disposed on an upper surface of the at least one of the plurality of anode vanes.

15. The crossed-field amplifier, as recited in claim 14, wherein the secondary emission regions are disposed on a first and a second side of the upper surface of the at least one of the plurality of anode vanes.

16. The crossed-field amplifier, as recited in claim 8, wherein the at least one anode vane is proximate an RF input port.

17. A crossed-field amplifier for amplifying a signal, comprising:

a cathode structure having an emitting surface which emits secondary electrons upon impingement of priming electrons incident thereon;

an anode structure surrounding the cathode and comprising a plurality of radially extending vanes;

a signal input port located at a circumferential portion of the anode structure;

secondary emission means disposed on selected ones of the vanes disposed in an area proximate the signal input port for providing the priming electrons in an interaction region of the amplifier by interaction with an input signal applied to the signal input port.

18. The crossed-field amplifier, as recited in claim 17, wherein said secondary emission means is disposed entirely on a surface of said selected ones of the vanes.

* * * * *